US008246136B2

(12) United States Patent
Kato et al.

(10) Patent No.: US 8,246,136 B2
(45) Date of Patent: Aug. 21, 2012

(54) RECORDING APPARATUS INCLUDING TWO ATTRACTION DEVICES FOR ATTRACTING RECORDING MEDIUM

(75) Inventors: Shigeki Kato, Toyoake (JP); Koji Ito, Gifu (JP); Manabu Hibi, Nagoya (JP); Naokatsu Osawa, Nagoya (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 286 days.

(21) Appl. No.: 12/725,949

(22) Filed: Mar. 17, 2010

(65) Prior Publication Data

US 2010/0245448 A1 Sep. 30, 2010

(30) Foreign Application Priority Data

Mar. 30, 2009 (JP) ..... 2009-081291

(51) Int. Cl.
*B41J 29/38* (2006.01)

(52) U.S. Cl. ..... 347/16; 347/104

(58) Field of Classification Search ..... 347/16, 347/101, 104

See application file for complete search history.

(56) References Cited

U.S. PATENT DOCUMENTS

| | | | | |
|---|---|---|---|---|
| 5,531,436 | A | 7/1996 | Ohyama et al. | |
| 5,821,968 | A * | 10/1998 | Ohyama et al. | 347/104 |
| 5,893,009 | A * | 4/1999 | Yamada | 399/44 |
| 2005/0128275 | A1 | 6/2005 | Uji et al. | |
| 2005/0270355 | A1 | 12/2005 | Sootome et al. | |
| 2009/0052917 | A1 | 2/2009 | Kogure et al. | |
| 2010/0021219 | A1 | 1/2010 | Hori | |

FOREIGN PATENT DOCUMENTS

| | | | |
|---|---|---|---|
| JP | H07-137877 | A | 5/1995 |
| JP | H11-151842 | A | 6/1999 |
| JP | 2001-199071 | A | 7/2001 |
| JP | 2002-046310 | A | 2/2002 |
| JP | 2005-231814 | A | 9/2005 |
| JP | 2005-343636 | A | 12/2005 |
| JP | 2007-021918 | A | 2/2007 |
| JP | 2007-119223 | A | 5/2007 |
| JP | 2007-230035 | A | 9/2007 |

(Continued)

OTHER PUBLICATIONS

European Patent Office, Extended European Search Report for Application No. EP10156381.5, dated Aug. 18, 2010.

(Continued)

*Primary Examiner* — Juanita D Jackson
(74) *Attorney, Agent, or Firm* — Baker Botts L.L.P.

(57) ABSTRACT

A recording apparatus including: a head having an ejection surface; and a recording-medium conveyor device having a conveyor member with a conveyor surface, wherein the apparatus further includes a first and a second attraction device each for permitting the medium on the conveyor surface to be attracted thereto. The first device includes: a first and a second electrode each being opposed to one surface of the medium opposite to another surface thereof facing the ejection surface; and a first voltage applicator to apply a voltage between the first and second electrodes. The second device includes: an electrifying body and a third electrode between which at least one of the medium and the conveyor member is sandwiched; and a second voltage applicator to apply a voltage between the electrifying body and the third electrode. The second device is for electrifying the at least one of the medium and the conveyor member.

18 Claims, 15 Drawing Sheets

FOREIGN PATENT DOCUMENTS

WO 2008-078446 A1 7/2008

OTHER PUBLICATIONS

The State Intellectual Property Office of the People'S Republic of China, Notification of First Office Action for Chinese Patent Application No. 201010144738.7, issued Aug. 23, 2011.

Japan Patent Office, Notification of Reasons for Refusal for Japanese Patent Application No. 2009-081291, dispatched Mar. 15, 2011.

European Patent Office, extended European Search Report for European Patent Application No. 12151606.6, dated Mar. 8, 2012.

* cited by examiner

RECORDING APPARATUS INCLUDING TWO ATTRACTION DEVICES FOR ATTRACTING RECORDING MEDIUM

CROSS REFERENCE TO RELATED APPLICATION

The present application claims priority from Japanese Patent Application No. 2009-081291, which was filed on Mar. 30, 2009, the disclosure of which is herein incorporated by reference in its entirety.

BACKGROUND OF THE INVENTION

1. Field of the Invention

The present invention relates to a recording apparatus having a conveyor device configured to convey a recording medium.

2. Discussion of Related Art

There is known a technique of conveying, to a recording head, a recording medium while the recording medium is being attracted to a conveyor member. In the technique, the recording medium placed on a conveyor surface of the conveyor member is attracted to the conveyor surface by utilizing electrodes disposed on one side of the conveyor member that is opposite to the other side thereof on which the conveyor surface is provided. There is also known a technique of attracting the recording medium to the conveyor member by permitting an electric current to pass through the conveyor member and charging the conveyor member.

SUMMARY OF THE INVENTION

According to the technique described above, the attractive force varies depending upon the environmental humidity for the following reason. In the technique, the attractive force between the recording medium and the conveyor member relies on the amount of the electric current that passes through the conveyor member and the recording medium when the voltage is applied by the electrodes, and the amount of the electric current relies on the humidity. When the humidity is low, the resistance of the recording medium is large, so that the electric current does not tend to flow through the recording medium and the attractive force may be reduced. According to the technique of charging the conveyor member, the conveyor member is not sufficiently charged when the humidity is high, causing a risk that the attractive force is not sufficiently obtained. Where the attractive force is not sufficiently obtained, it is impossible to stably convey the recording medium to the recording head.

It is therefore an object of the invention to provide a recording apparatus in which a recording medium can be stably conveyed even where the environment, the type of the recording medium, or the like, changes.

The above-indicated object may be attained according to a principle of the invention, which provides a recording apparatus comprising:

a recording head having an ejection surface from which a liquid is ejected; and a conveyor device having a conveyor member with a conveyor surface which is opposed to the ejection surface and on which a recording medium is placed, the conveyor device being configured to convey the recording medium in a conveyance direction by moving the conveyor member, wherein the recording apparatus further comprises a first attraction device and a second attraction device each of which is configured to permit the recording medium placed on the conveyor surface to be attracted to the conveyor surface, wherein the first attraction device includes: a first electrode and a second electrode each of which is opposed to one surface of the recording medium that is opposite to another surface thereof facing the ejection surface, with the recording medium placed on the conveyor surface; and a first voltage applicator configured to apply a voltage between the first electrode and the second electrode, and wherein the second attraction device includes: an electrifying body and a third electrode between which at least one of the recording medium and the conveyor member is sandwiched; and a second voltage applicator configured to apply a voltage between the electrifying body and the third electrode, the second attraction device being configured to electrify the at least one of the recording medium and the conveyor member.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter described embodiments of the invention with reference to the drawings.

Figure 1:
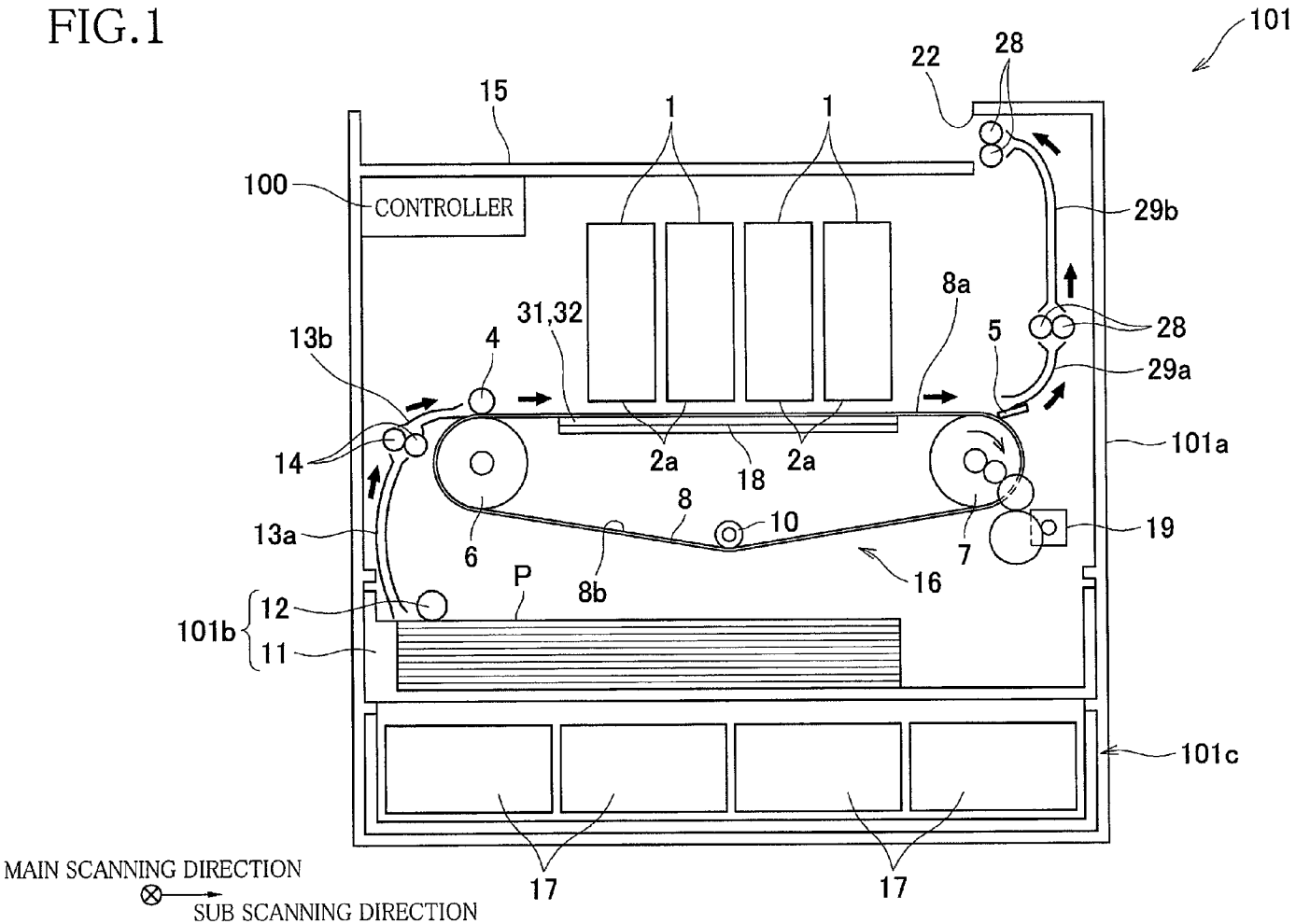
FIG. 1 is a view schematically showing an internal structure of an ink-jet printer according to one embodiment of the invention.

As shown in FIG. 1, an ink-jet printer 101 as a recording apparatus according to one embodiment of the invention has a casing 101*a* which has a rectangular parallelepiped shape. In the casing 101*a*, there are disposed four ink-jet heads 1, each as a recording head, which respectively eject a magenta ink, a cyan ink, a yellow ink, and a black ink. Each ink-jet head 1 will be hereinafter simply referred to as the "head 1". To the inner surface of the top plate of the casing 101*a*, there is attached a controller 100 configured to control operations of the heads 1 and so on.

The four heads 1 eject mutually different colors of inks as described above. Each head 1 has a generally rectangular parallelepiped shape that is long in a main scanning direction. The four heads 1 are fixed so as to be arranged in a sheet conveyance direction in which a sheet P as a recording medium is conveyed. That is, the printer 101 is a line-type printer. The sheet conveyance direction is perpendicular to the main scanning direction.

The bottom surface of each head 1 is formed as an ejection surface 2*a* in which are formed a plurality of ejection openings through which the ink is ejected. The different colors of inks are ejected from the ejection openings of the respective heads 1 toward an upper surface of a printing sheet (as the recording medium) disposed below the heads 1.

There is disposed, near the bottom of the casing 101*a*, an ink tank unit 101*c* for supplying the inks to the respective heads 1. The ink tank unit 101*c* has four ink tanks 17 connected to the respective heads 1. The four ink tanks 17 store the mutually different colors of inks. The ink in each ink tank 17 is supplied to the corresponding head 1 through a tube.

There is disposed, below the heads 1, a sheet supply unit 101*b* from which are supplied the printing sheets on which a printing operation is conducted by the heads 1. The sheet supply unit 101*b* has a sheet tray 11 and a sheet supply roller 12. The sheet tray 11 has a box-like shape opening upward, and a stack of the sheets P is accommodated in the sheet tray 11. The sheet supply roller 12 is configured to supply an uppermost one of the sheets P in the sheet tray 11.

A conveyor device 16 is disposed between the heads 1 and the sheet supply unit 101*b*. The conveyor device 16 is configured to convey the sheet P supplied from the sheet supply unit 101*b* such that the sheet P is horizontally conveyed under the heads 1. The conveyor device 16 is controlled by the controller 100 so as to convey the printing sheet along a sheet transfer or conveyance path indicated by solid arrows in FIG. 1. The sheet P supplied from the sheet supply unit 101*b* is guided by guides 13*a*, 13*b* and is supplied to the conveyor device 16 while being held by rollers of a roller pair 14.

The conveyor device 16 includes two belt rollers 6, 7, a conveyor belt 8 as a conveyor member, a tension roller 10, and a platen 18. The conveyor belt 8 is an endless belt wound around the two rollers 6, 7 so as to be stretched therebetween. The tension roller 10 is biased downward at a lower loop portion of the conveyor belt 8 while being in contact with an inner surface 8*b* of the conveyor belt 8 and gives tension to the conveyor belt 8.

The belt roller 7 is a drive roller and is configured to be rotated clockwise in FIG. 1 by a drive force transmitted to its shaft from a conveyance motor 19. The belt roller 6 as a conveyance roller is a driven roller and is configured to be rotated clockwise in FIG. 1 by the movement of the conveyor belt 8 in accordance with the rotation of the belt roller 7. The drive force of the conveyance motor 19 is transmitted to the belt roller 7 via a plurality of gears.

Figure 2:
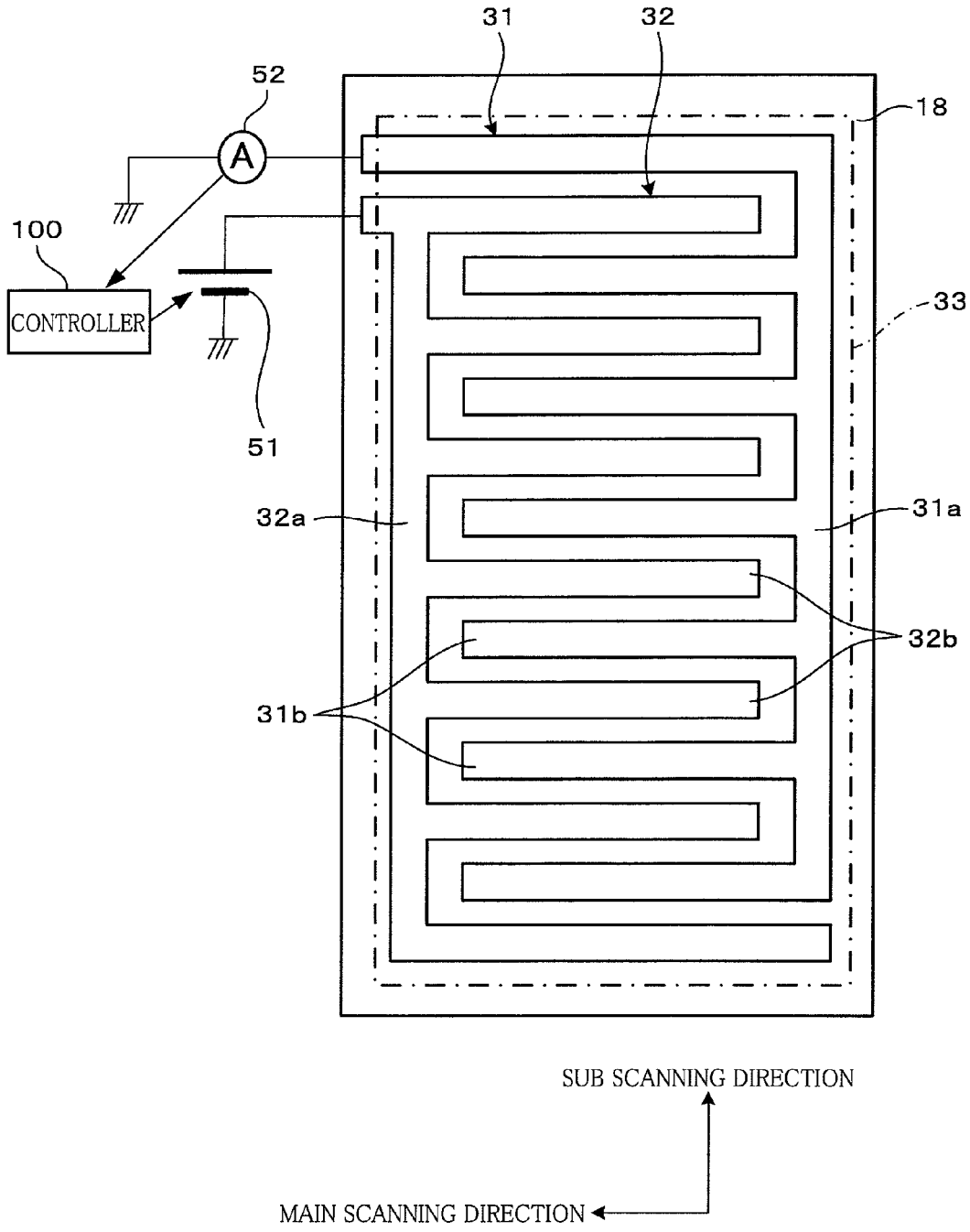
FIG. 2 is a plan view of a platen shown in FIG. 1.

The platen 18 has a generally rectangular parallelepiped shape having a size that contains the ink ejection area by the heads 1, in a plan view. The platen 18 is disposed within a region enclosed by the conveyor belt 8 so as to be opposed to the heads 1. The platen 18 supports the conveyor belt 8 so as to prevent the conveyor belt 8 from sagging downward. The platen 18 is disposed such that the upper portion thereof is horizontal along the conveyor belt 8, and electrodes 31, 32 (as a first electrode and a second electrode) formed of a metal are fixed to the upper portion of the platen 18, as shown in FIG. 2. A protective layer 33 formed of a resin is provided on the upper surfaces of the respective electrodes 31, 32 so as to protect the electrodes 31, 32. The protective layer 33 is formed so as to cover the entirety of the two electrodes 31, 32 in a plan view. FIG. 2 shows a state in which the protective layer 33 is removed, and the region of the protective layer 33 is indicated by the one-dot chain line. The protective layer 33 is in contact with the conveyor belt 8 from under the same 8, whereby the electrodes 31, 32 are prevented from directly contacting the conveyor belt 8. Thus, the electrodes 31, 32 are protected from being worn.

The electrode 31 has a connecting portion (beam portion) 31*a* extending in a sub scanning direction and a plurality of comb-tooth portions 31*b* extending in the main scanning direction. The connecting portion 31*a* is located near the right end portion of the platen 18 as seen in FIG. 2. The comb-tooth portions 31*b* are connected to the connecting portion 31*a* at the right end portion of the platen 18 as seen in FIG. 2 and extend leftward from the connecting portion 31*a* as seen in FIG. 2. The comb-tooth portions 31*b* are equally spaced apart from each other in the sub scanning direction.

The electrode 32 has a connecting portion (beam portion) 32*a* extending in the sub scanning direction and a plurality of comb-tooth portions 32*b* extending in the main scanning direction. The connecting portion 32*a* is located near the left end portion of the platen 18 as seen in FIG. 2. The comb-tooth portions 32*b* are connected to the connecting portion 32*a* at the left end portion of the platen 18 as seen in FIG. 2 and extend rightward from the connecting portion 32*a* as seen in FIG. 2. The comb-tooth portions 32*b* are equally spaced apart from each other in the sub scanning direction such that any adjacent two comb-tooth portions 32*b* sandwich a corresponding one of the comb-tooth portions 31*b* therebetween.

The electrode 31 is connected to the ground via an ammeter 52 as a current sensor partially constituting a humidity detector, so that the electrode 31 is kept at the ground potential. The measured value of the ammeter 52 is sent to the controller 100. The electrode 32 is connected to the positive pole of a direct current (DC) power soured 51 as a first voltage applicator, and the negative pole of the DC power source 51 is connected to the ground. The power of the DC current 51 is variable, and the voltage to be applied between the electrode 31 and the electrode 32 is controlled by the controller 100.

Figure 4:
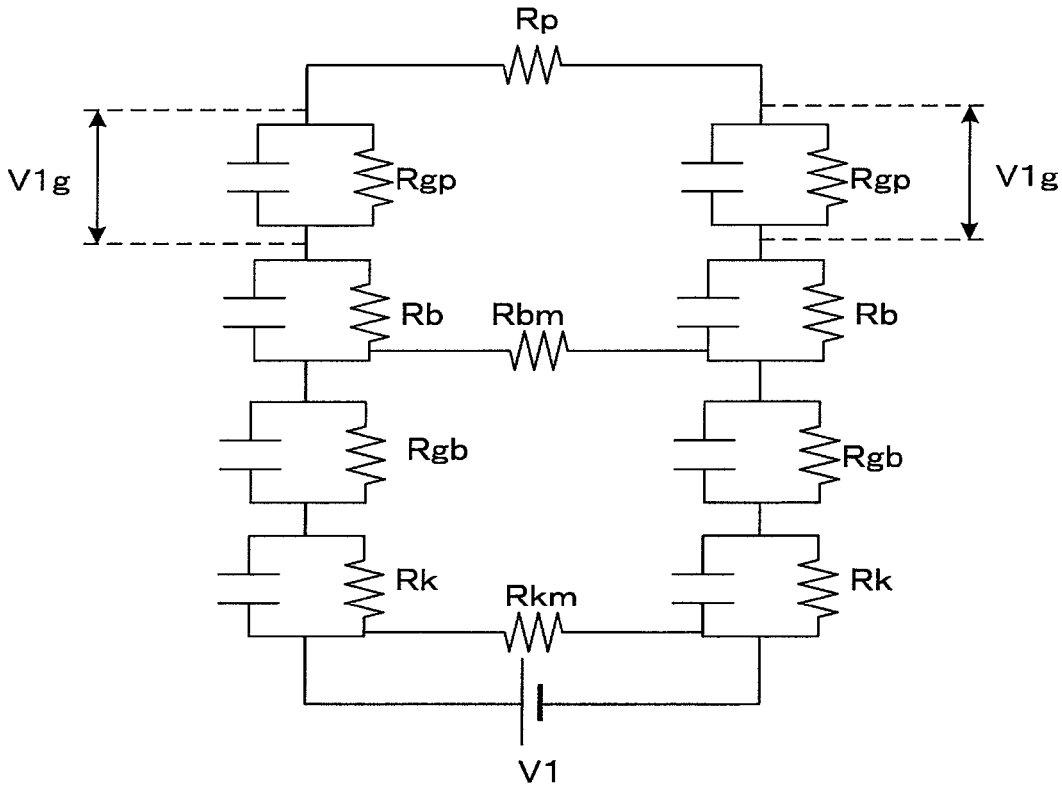
FIG. 4 is electric circuitry formed by a first attraction device.

When the voltage is applied between the electrodes 31, 32, the electric current flows therebetween through the conveyor belt 8 and the sheet P. FIG. 4 shows electric circuitry formed when a voltage V1 is applied between the electrodes 31, 32. The electric circuitry shown in FIG. 4 is one model assumed in an instance where the present embodiment is idealized as an electric structure. It is noted that electric circuitry according to another model that is different from this model may be assumed.

The electric circuitry includes a path from the electrode 32 to the electrode 31 via the conveyor belt 8, the sheet P, and the conveyor belt 8, namely, the electrode 32→the conveyor belt 8→the sheet P→the conveyor belt 8→the electrode 31. In FIG. 4, "Rk", "Rgb", "Rb", "Rgp", and "Rp" indicate electric resistances of respective portions along the path. More specifically, "Rk", "Rgb", "Rb", "Rgp", and "Rp" respectively indicate an electric resistance of the protective layer 33 between the electrodes 31, 32 and the conveyor belt 8, an electric resistance of a gap between the protective layer 33 and the conveyor belt 8, an electric resistance of the conveyor belt 8, an electric resistance of a gap between the conveyor belt 8 and the sheet P, and an electric resistance in the sheet P.

The electric circuitry described above includes two bypass paths that are parallel to the above-indicated path, and "Rkm" and "Rbm" in FIG. 4 indicate electric resistances of the bypass paths. More specifically, "Rkm" indicates an electric resistance of one of the two bypass paths that directly connects the two electrodes 31, 32 only via the protective layer 33. "Rbm" indicates an electric resistance of the other of the two bypass paths that connects a portion of the conveyor belt 8 opposed to the electrode 31 and a portion of the conveyor belt 8 opposed to the electrode 32, via the conveyor belt 8 not via the sheet P.

When a voltage is applied between the electrodes 31, 32, the electric charges are accumulated in the above-indicated members and gaps, so that there are formed capacitors that are connected in parallel to the respective electric resistances, as shown in FIG. 4. When an infinitesimal electric current flows through the gap between the sheet P and the conveyor belt 8 in relation to charging of the capacitors, there is generated an electric field in this gap. Accordingly, there is generated a Johnsen-Rahbeck force (attractive force) between the sheet P and the conveyor belt 8. Owing to the attractive force, the sheet P on the conveyor belt 8 is electrostatically attracted to an outer surface 8*a* as a conveyor surface of the conveyor belt 8.

The magnitude of the Johnsen-Rahbeck force is proportional to the magnitude of the electric field generated in the gap between the sheet P and the conveyor belt 8. The magnitude of the electric field generated in the gap between the sheet P and the conveyor belt 8 is proportional to the voltage applied to the gap. According to the circuitry structure shown in FIG. 4, the voltage V1*g* applied to the gap is represented by the following formula (1):

$$V1g=V1*Rgp*Ra/\{(2Rb+2Rgp+Rp)*(2Rk+2Rgb+Ra)\} \quad (1)$$

It is noted that "Ra" is represented as follows:

$$Ra=Rbm*(2Rb+2Rgb+Rp)/(Rbm+2Rb+2Rgp+Rp)$$

That is, in an instance where the voltage V1 is applied between the two electrodes 31, 32, the magnitude of the attractive force generated between the sheet P and the conveyor belt 8 is proportional to V1*g* represented by the above formula (1).

Figure 3:
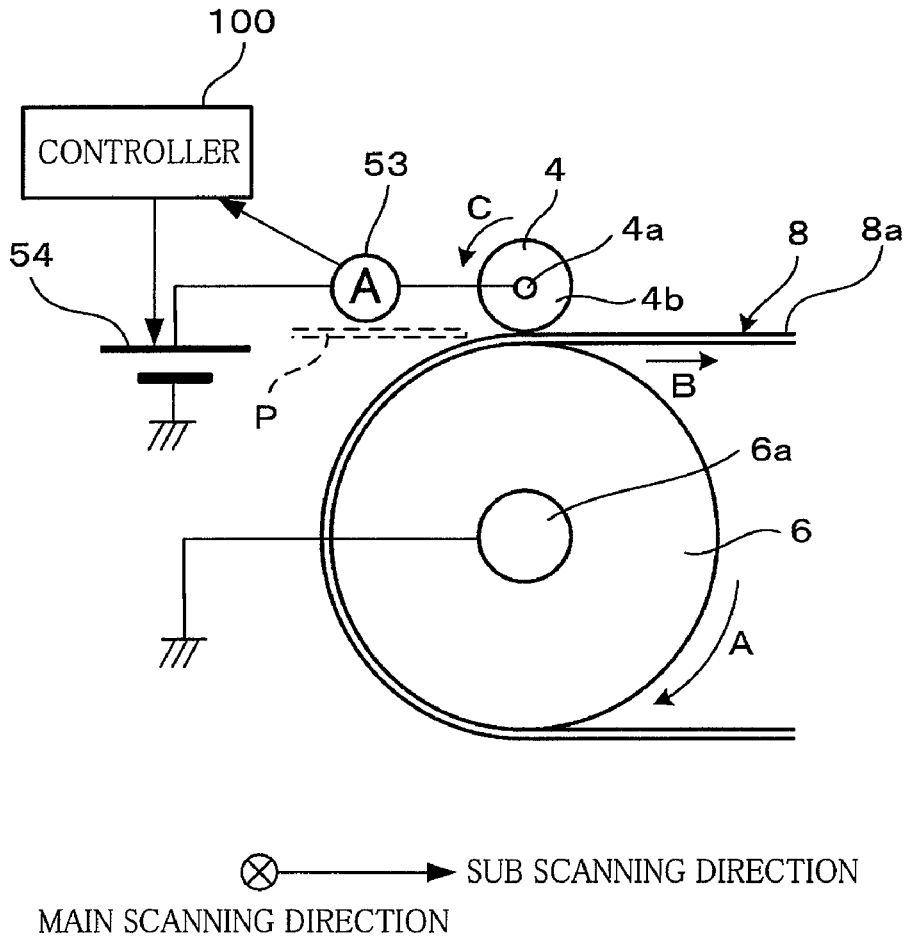
FIG. 3 is an enlarged view of a charge roller shown in FIG. 1 and its vicinity.

A charge roller 4 as an electrifying body is disposed so as to be opposed to the belt roller 6. More specifically, the charge roller 4 is disposed at a position where the charge roller 4 cooperates with the belt roller 6 to sandwich the conveyor belt 8 therebetween. The charge roller 4 has a generally cylindrical shape having an axis that extends in the main scanning direction. The charge roller 4 extends substantially over a distance between opposite ends of the conveyor belt 8 as seen in the main scanning direction. As shown in FIG. 3, the charge roller 4 includes a rotation shaft 4*a* and a roller body 4*b* fixed to the outer circumference of the rotation shaft 4*a*. The rotation shaft 4*a* is formed of a metallic material while the roller body 4*b* is formed of an elastic material having electrically conductive property or semiconductive property. The rotation shaft 4*a* is connected to the positive pole of a direct current (DC) power source 54 as a second voltage applicator via an ammeter 53 as a current sensor partially constituting the humidity detector, and the negative pole of the DC power source 54 is connected to the ground. The measured value of the ammeter 53 is sent to the controller 100. The power of the DC power source 54 is variable, and the voltage to be applied to the rotation shaft 4*b* is controlled by the controller 100. In the meantime, the rotation shaft of the belt roller 6 is connected to the ground. In the present embodiment, the belt roller 6 functions as a third electrode.

When the belt roller 6 is driven, the belt roller 7 rotates in a direction indicated by "A" in FIG. 3 and the conveyor belt 8 moves in a direction indicated by "B" in FIG. 3. In accordance with the rotation of the belt roller 6 and the movement of the conveyor belt 8 described above, the charge roller 4 rotates in a direction indicated by "C" in FIG. 3 while cooperating with the outer surface 8*a* of the conveyor belt 8 to sandwich, therebetween, the sheet P supplied from the sheet supply unit 101. In this state, when a suitable voltage is applied to the rotation shaft 4*a*, the electric current flows from the charge roller 4 toward the sheet P, and the sheet P is positively charged. On the other hand, the negative charge is supplied to the conveyor belt 8 via the belt roller 6 connected to the ground, so that the conveyor belt 8 is negatively charged. Accordingly, the positively charged sheet P is electrostatically attracted to the negatively charged conveyor belt 8.

Figure 5:
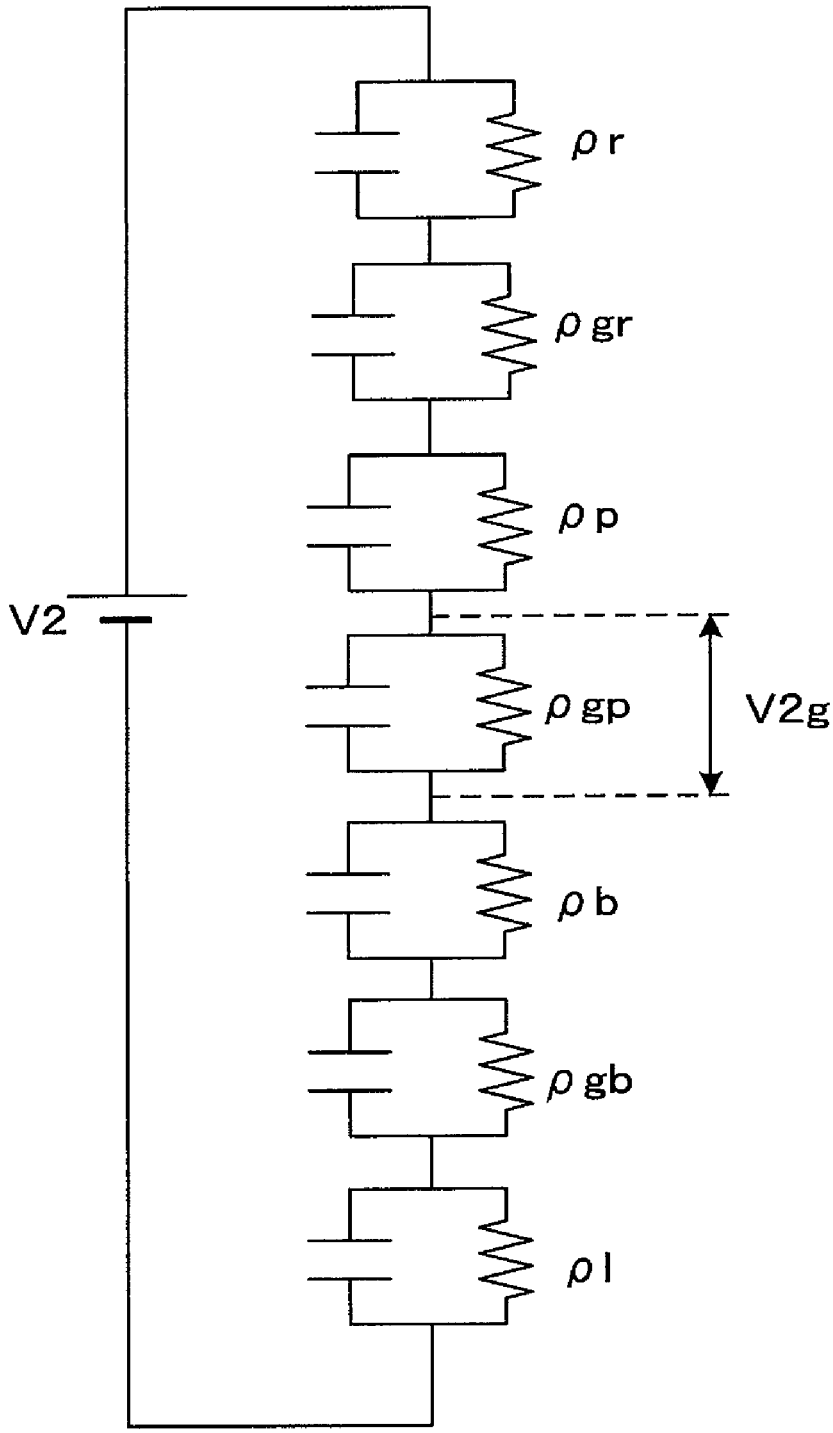
FIG. 5 is electric circuitry formed by a second attraction device.

By application of the voltage between the charge roller 4 and the belt roller 6 by the DC power source 54, the electric current flows through the charge roller 4, the sheet P, and the conveyor belt 8. That is, the conveyor belt 8 and the sheet P are electrified by the charge roller 4 and the belt roller 6. FIG. 5 shows electric circuitry formed when a voltage V2 is applied between the charge roller 4 and the belt roller 6. The electric circuitry shown in FIG. 5 is one model assumed in an instance where the present embodiment is idealized as an electric structure. It is noted that electric circuitry according to another model that is different from this model may be assumed.

The electric circuitry shown in FIG. 5 is constituted by a path from the charge roller 4 to the belt roller 6 via the sheet P and the conveyor belt 8, namely, the charge roller 4→the sheet P→the conveyor belt 8→the belt roller 6. In FIG. 5, "ρr" and so on indicate electric resistances of respective portions along the path. More specifically, "ρr", "ρgr", "ρp", "ρgp", "ρb", "ρgb", and "ρl" respectively indicate an electric resistance of the charge roller 4, an electric resistance of a gap between the charge roller 4 and the sheet P, an electric resistance of the sheet P, an electric resistance of a gap between the sheet P and the conveyor belt 8, an electric resistance of the conveyor belt 8, an electric resistance of a gap between the conveyor belt 8 and the belt roller 6, and an electric resistance of the belt roller 6.

As described above, there are provided, in the present embodiment, two attraction devices, namely, a first attraction device including the electrodes 31, 32 and a second attraction device including the charge roller 4 and the belt roller 6. The first attraction device and the second attraction device function owing to the voltages respectively applied from the DC power sources 51, 54 and generate the respective attractive forces by which the sheet P is attracted to the conveyor belt 8. The sheet P is conveyed in the sheet conveyance direction shown in FIG. 1 that is parallel to the sub scanning direction, in accordance with the movement of the conveyor belt 8 while being supported or held on the outer surface 8*a* owing to the attractive forces. The thus conveyed sheet P passes under the heads 1 and reaches the belt roller 7. The controller 100 controls the heads 1 to eject the inks therefrom when the sheet P passes under the heads 1 while controlling the conveyance of the sheet P, so that a desired image is formed on the upper surface of the sheet P.

A separation plate 5 is disposed so as to be opposed to the belt roller 7 with the conveyor belt 8 interposed therebetween. The separation plate 5 is configured to separate the sheet P on which the image has been formed from the outer surface 8*a* of the conveyor belt 8. The separated sheet P is guided by guides 29*a*, 29*b* and conveyed while being held by and between rollers of two feed roller pairs 28. Subsequently, the sheet P is discharged to the discharged-sheet receiving portion 15 provided on the upper surface of the top plate of the casing 101*a* through an outlet 22 formed at the upper portion of the casing 101*a*.

In the meantime, the applicant of the invention has found that the attractive forces generated by the above-indicated first and second attraction devices change depending upon the environmental humidity. More specifically, the applicant has found that the attractive force by the first attraction device is reduced when the humidity becomes low to a certain extent while the attractive force by the second attraction device is reduced when the humidity becomes high to a certain extent. The applicant has reached consideration that the reduction of the attractive forces is caused because the electric current gets hard to flow between the sheet P and the conveyor belt 8 and because the sheet P and the conveyor belt 8 get hard to be electrically charged, as a result of changes in the electric resistances of the sheet P and the conveyor belt 8 in accordance with the humidity.

In an instance where the humidity is low, for instance, the electric resistances of the sheet P and the conveyor belt 8 generally become too large, so that the electric current passing through the electrodes 31, 32 is decreased and the Johnsen-Rabeck force is not substantially generated. On the contrary, in an instance where the humidity is high, the electric resistances of the sheet P and the conveyor belt 8 generally become too small. In this instance, since the electric charge is dispersed from the sheet P toward the other members and in the air even if the electric current flows from the charge roller 4 toward the sheet P, the sheet P is not likely to be electrically charged.

Therefore, in an arrangement in which only one of the first attraction device and the second attraction device is provided, the sheet P cannot be sufficiently attracted to the conveyor belt 8 when the humidity is excessively high or low. However, in the present embodiment in which both of the first attraction device and the second attraction device are provided, it is possible to sufficiently obtain the attractive force generated by at least one of the first and second attraction devices even if the humidity becomes excessively high or low.

In the meantime, the magnitude of the attractive force owing to the Johnsen-Rabeck force generated by the first attraction device relies on the voltage V1*g* represented by the above-indicated formula (1). The electric resistances Rp, Rb, Rbm, Rgp, etc., of the sheet P, the conveyor belt 8, the gap of the sheet P and the conveyor belt 8, etc., change depending upon the humidity. The way of change of the electric resistances relies on the property of those members and the air. When the humidity becomes considerably low, the electric resistances of those members and the air are increased, so that the attractive force to be generated by the first attraction device is reduced as described above. When the amount of change in the humidity is small, however, the amounts of change in the respective electric resistances Rp, Rb, Rbm, Rgp, etc., differ from one another in accordance with the property of those members and the air. Accordingly, it is impossible to determine only from the above-indicated formula (1) whether the voltage V1*g* becomes small or becomes large, and it is not clear whether the attractive force becomes small or becomes large.

Figure 6A:
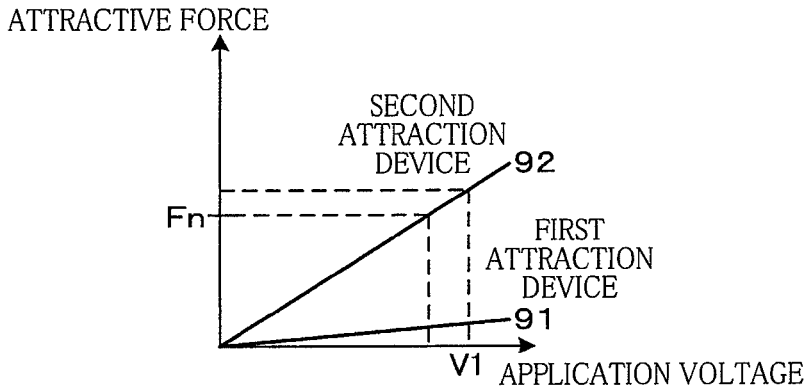
FIGS. 6A-6C are graphs each showing an attractive force measured with an application voltage varied in each of the first and second attraction devices, the humidity being 10% in FIG. 6A, 50% in FIG. 6B, and 90% in FIG. 6C.
Figure 6B:
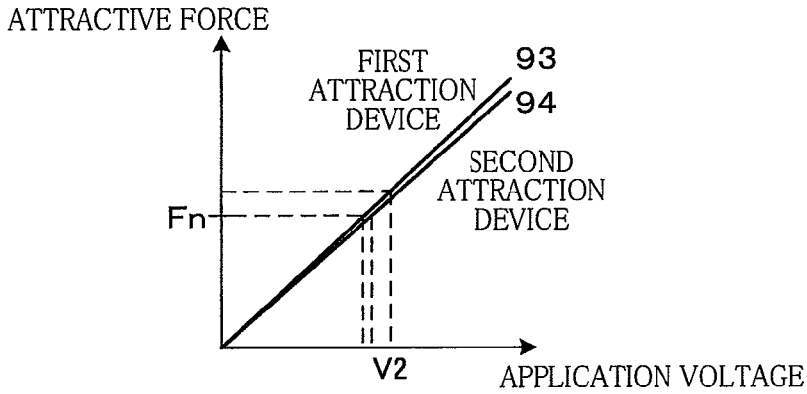
Figure 6C:
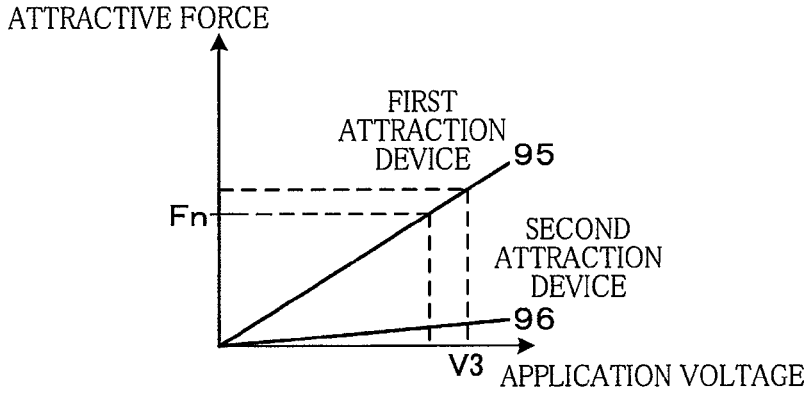

In view of the above, the applicant conducted the following measurements. More specifically, the attractive forces to be generated by the respective first and second attraction devices according to a certain embodiment were measured with the voltages to be applied (i.e., application voltages) by the respective DC power sources 51, 54 varied, in environments in which the humidity values are different from each other. The graphs of FIGS. 6A-6C show the results of the measurements. The graph of FIG. 6A shows the measurement result when the relative humidity is 10%, the graph of FIG. 6B shows the measurement result when the relative humidity is 50%, and the graph of FIG. 6C shows the measurement result when the relative humidity is 90%. The lines 91, 93, 95 in the graphs indicate the measured attractive force generated by the first attraction device while the lines 92, 94, 96 in the graphs indicate the measured attractive force generated by the second attraction device. In the graphs, "Fn" indicates the magnitude of the attractive force required for sufficiently attracting the sheet P to the conveyor belt 8.

As apparent from the graphs of FIGS. 6A and 6C, the attractive force generated by the first attraction device is considerably small when the humidity is 10% while the attractive force generated by the second attraction device is considerably small when the humidity is 90%. On the other hand, as apparent from the graph of FIG. 6B, the first attraction device and the second attraction device generate substantially the same degree of attractive forces when the humidity is 50%.

On the basis of the results of measurements under a plurality of conditions that include the above-indicated three humidity values, it is assumed that the application voltage that certainly assures the attractive force larger than "Fn" is obtained in each of the following three cases: (1) a case in which the humidity is less than 30% as first threshold humidity; (2) a case in which the humidity is held in a range of 30-70%; and (3) a case in which the humidity is higher than 70% as second threshold humidity. More specifically, the attractive force generated by the second attraction device certainly exceeds "Fn" in the case (1) where the application voltage by the DC power source 54 is V1(>0). The attractive force generated by the first attraction device and the attractive force generated by the second attraction device certainly exceed "Fn" in the case (2) where the application voltages by the respective DC power sources 51, 54 are V2(>0) that is smaller than V1. Further, the attractive force generated by the first attraction device certainly exceeds "Fn" in the case (3) where the application voltage by the DC power source 51 is V3 that is larger than V2 and smaller than V1. Refer to FIGS. 6A-6C.

Figure 7:
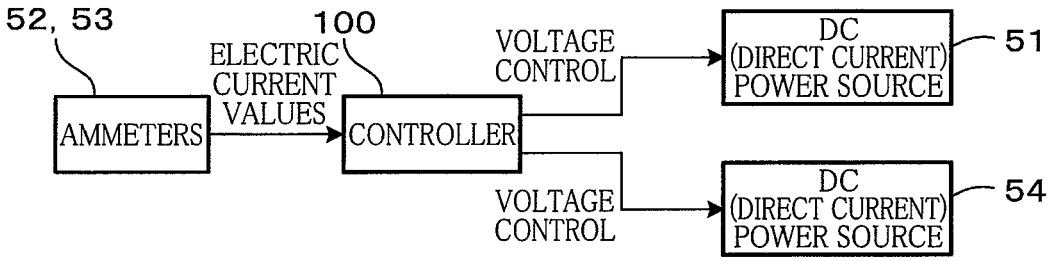
FIG. 7 shows a functional block diagram showing controls by a controller.

The controller 100 in the present embodiment is configured to control the DC power sources 51, 54 as follows (FIG. 7) in accordance with the humidity, on the basis of the measurement results described above. The controller 100 is constituted by hardware including processing circuits, memory, and the like and software including programs, data and the like which makes the hardware to work so as to execute various controls. It is noted that the entirety of the controller 100 may not be constituted by the combination of the hardware and the software, but may be constituted by circuits and the like a portion or the entirety of which is specialized for various functions.

The controller 100 is configured to control the DC power sources 51, 54 to apply respective prescribed voltages and to detect the humidity in accordance with results of measurements by the respective ammeters 52, 53. When the relative humidity becomes high and the electric resistances of the sheet P and the conveyor belt 8 become small as a result of moisture absorption by the sheet P and the conveyor belt 8, the electric current tends to flow between the electrodes 31, 32, so that the measured value of the ammeter 52 increases. Accordingly, it can be said that the larger the measured value of the ammeter 52, the higher the relative humidity. In the meantime, when the relative humidity becomes high and the electric resistance of the charge roller 4 becomes small, the electric current flowing through the charge roller 4 increases, so that the measured value of the ammeter 53 increases. Accordingly, it can be said that the larger the measured value of the ammeter 53, the higher the relative humidity. It is noted that the relative humidity may be detected based on only one of the result of measurement by the ammeter 52 and the result of measurement by the ammeter 53. Thus, the ammeters 52, 53 constitute a part of the humidity detector.

Figure 8:
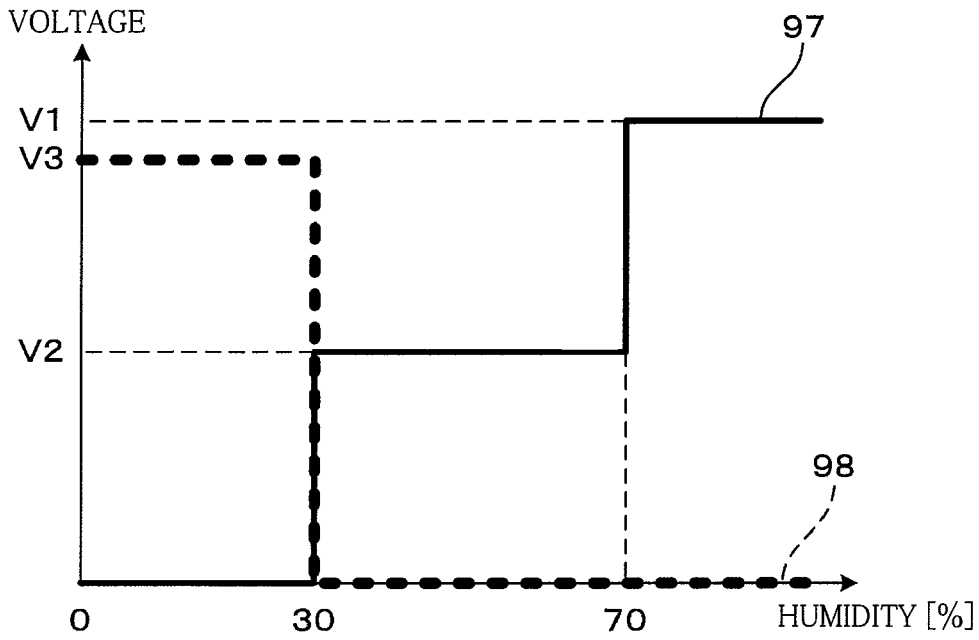
FIG. 8 is a graph showing changes of the voltages applied by respective direct current (DC) power sources under a control of the controller.

The controller 100 is configured to determine, on the basis of the detected humidity, the application voltages by the respective DC power sources 51, 54 according to the graph of FIG. 8, such that the attractive force to be generated by the first attraction device and the attractive force to be generated by the second attraction device exceed "Fn". The controller 100 stores data corresponding to the graph of FIG. 8 in which the measured values of the respective ammeters 52, 53 and the application voltages are correlated with each other, and controls the application voltages by the respective DC power sources 51, 54 on the basis of the data indicated above and the measured values of the respective ammeters 52, 53. In this way, the DC power sources 51, 54 apply the respective voltages in accordance with the change of the humidity. The solid line 97 in the graph of FIG. 8 indicates a change of the application voltage by the DC power source 51 controlled by the controller 100 while the broken line 98 in the graph of FIG. 8 indicates a change of the application voltage by the DC power source 54 controlled by the controller 100.

More specifically, the controller 100 is configured to control the DC power source 51 to apply a zero voltage, namely, to control the DC power source such that the voltage to be applied by the DC power source 51 is reduced to zero, and to control the DC power source 54 to apply the voltage V3, where the humidity indicated by the measured electric currents is less than 30%. In other words, where the humidity is less than 30%, the first attraction device is placed in the off state whereas the second attraction device is placed in the on state.

Further, the controller 100 is configured to control the DC power source 51 to apply the voltage V2 and to control the DC power source 54 to apply a zero voltage, namely, to control the DC power source 54 such that the voltage to be applied by the DC power source 54 is reduced to zero, where the humidity indicated by the measured electric currents is held in the range of 30-70%. In other words, where the humidity is in the range of 30-70%, the first attraction device is placed in the on state whereas the second attraction device is placed in the off state.

Moreover, the controller 100 is configured to control the DC power source 51 to apply the voltage V1 and to control the DC power source 54 to apply a zero voltage, namely, to control the DC power source 54 such that the voltage to be applied by the DC power source 54 is reduced to zero, where the humidity indicated by the measured electric currents is higher than 70%. In other words, where the humidity is higher than 70%, the first attraction device is placed in the on state whereas the second attraction device is placed in the off state.

In the embodiment illustrated above, the required attractive force "Fn" can be obtained even if the humidity changes, so that the sheet P on the conveyor belt 8 can be stably conveyed to an appropriate position under the ink-jet heads 1.

In the embodiment illustrated above, the second attraction device is placed in the on state while the first attraction device is placed in the off state, when the humidity is less than 30%. Since the first attraction device does not substantially contribute to the attraction force when the humidity is low, the power consumption is restrained or reduced by placing the first attraction device in the off state. Further, in the first attraction device, even if the electric current that flows between the electrodes 31, 32 becomes small, it is not possible to completely avoid charging of the conveyor belt 8 and so on, namely, it is inevitable that the conveyor belt 8 and so on are somewhat charged. When the conveyor belt 8 is charged, the electric charge is accumulated on the conveyor surface of the conveyor belt 8, whereby there may be caused a risk that ink attaching positions at which the ink ejected from the heads 1 is to be attached to the sheet P deviate from intended positions, due to electric interaction between the ink ejected from the heads 1 and the charged conveyor belt 8. In the present embodiment, however, since the first attraction device is placed in the off state, it is possible to obviate the problem described above.

Moreover, in the embodiment illustrated above, the first attraction device is placed in the on state while the second attraction device is placed in the off state, when the humidity is higher than 70%. Since the second attraction device does not substantially contribute to the attraction force when the humidity is high, the power consumption is restrained or reduced by placing the second attraction device in the off state. Further, when the humidity is high, the electric resistances of the charge roller 4, the sheet P, and the conveyor belt 8 are decreased. In this case, if the second attraction device is kept placed in the on state, there may be caused a risk that the electric current excessively flows among the charge roller 4, the sheet P, and the conveyor belt 8. In addition, there may be caused a risk that the conveyor belt 8 suffers from a breakage. In the present embodiment, however, since the second attraction device is placed in the off state, it is possible to obviate the problems described above.

In the embodiment illustrated above, the first attraction device is placed in the on state while the second attraction device is placed in the off state, when the humidity is held in the range of 30-70%, for the following reason. When the second attraction device is placed in the on state, the sheet P is charged, so that there may be caused a risk that the ink attaching positions at which the ink ejected from the heads 1 is to be attached to the sheet P deviate from the intended positions, due to electric interaction between the ink droplets ejected from the heads 1 and the sheet P. In view of this, it is preferable to use, instead of the second attraction device, the first attraction device as much as possible, for the purpose of permitting the sheet P to be attracted to the conveyor belt 8.

As explained above, the range of the humidity is divided into the three sub-ranges in each of which the application voltage that assures the attractive force "Fn" is determined in the manner described above. The thus determined application voltages corresponding to the respective three sub-ranges of the humidity are suitably applied depending upon the detected humidity. Thus, it is possible to obtain a sufficient degree of attractive force by the simple control, irrespective of changes of the humidity described above Hereinafter, there will be explained first through seventh modified embodiment of the invention with reference to FIGS. 9-15. The first through third modified embodiments respectively employ charge rollers 102, 204, 304, each as the electrifying body, in place of the charge roller 4 employed in the illustrated embodiment of FIGS. 1-8.

Figure 9:
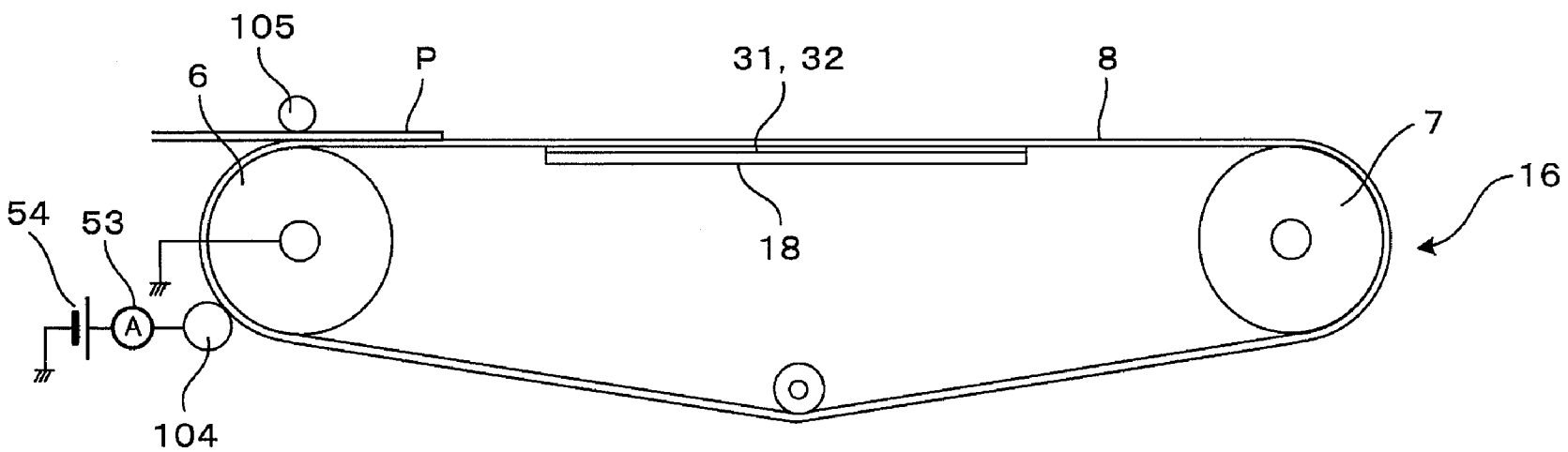
FIG. 9 is a view showing a structure of a conveyor device and its vicinity according to a first modified embodiment.

As shown in FIG. 9, like the charge roller 4 of the illustrated embodiment of FIGS. 1-8, the charge roller 104 according to the first modified embodiment is disposed so as to be opposed to the belt roller 6. However, the charge roller 104 is not disposed so as to cooperate with the belt roller 6 to sandwich the sheet P therebetween, but is disposed at a position which is distant from the position where the charge roller 4 is disposed shown in FIG. 1, by a suitable distance in the counterclockwise direction along the outer circumference of the belt roller 6, as shown in FIG. 9. A pressing roller 105 is disposed at a position where the pressing roller 105 cooperates with the belt roller 6 to sandwich the sheet P therebetween. The charge roller 104 is connected to the DC power source 54 via the ammeter 53. When the voltage is applied to the charge roller 104, the electric current flows from the charge roller 104 toward the conveyor belt 8, and the conveyor belt 8 is electrically charged. In other words, the conveyor belt 8 is electrified by the charge roller 104 and the belt roller 6. The sheet P pressed onto the conveyor surface 8*a* of the conveyor belt 8 by the pressing roller 105 is attracted to the charged conveyor belt 8.

Figure 10:
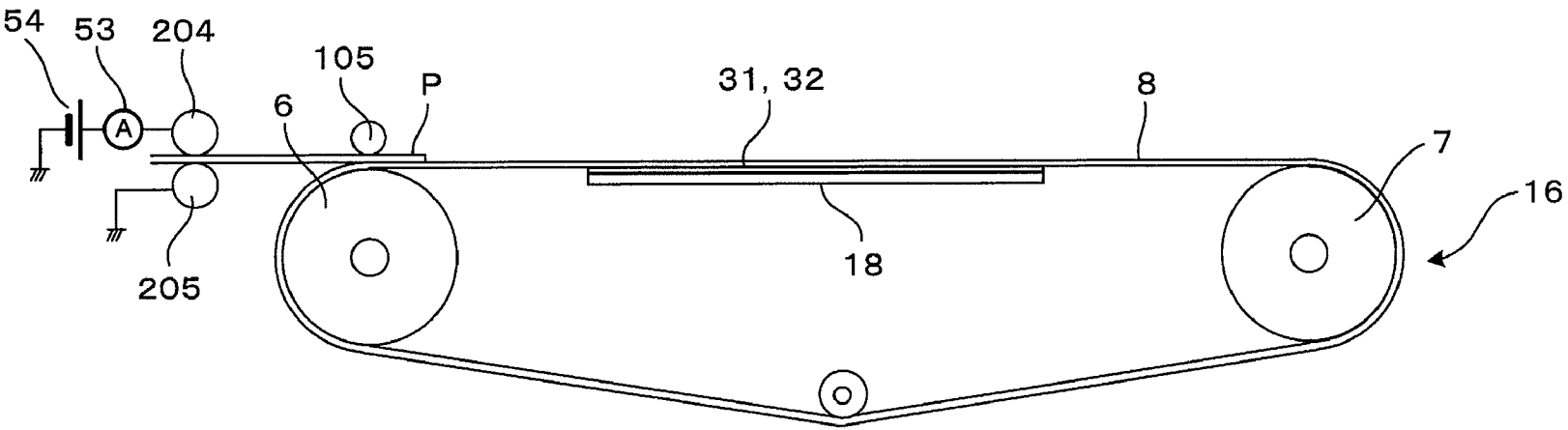
FIG. 10 is a view showing a structure of a conveyor device and its vicinity according to a second modified embodiment.

As shown in FIG. 10, the charge roller 204 according to the second modified embodiment is disposed on the upstream side of the position at which the pressing roller 105 is disposed, in the sheet conveyance direction. A feed roller 205 is disposed under or vertically downward of the charge roller 204, so as to cooperate with the charge roller 204 to sandwich the sheet P therebetween. As in the first modified embodiment of FIG. 9, the pressing roller 105 is disposed over the belt roller 6. The feed roller 205 is configured to feed or send the sheet P toward the pressing roller 105 while cooperating with the charge roller 204 to sandwich the sheet P therebetween. The charge roller 204 is connected to the DC power source 54 via the ammeter 53. When the voltage is applied to the charge roller 204, the electric current flows from the charge roller 204 toward the sheet P, and the sheet P is electrically charged. In other words, the sheet P is electrified by the charge roller 204 and the feed roller 205. When the charged sheet P reaches the position at which the pressing roller 105 is disposed, the sheet P is pressed onto the conveyor surface 8*a* of the conveyor belt 8 by the pressing roller 105 and is attracted to the conveyor belt 8. In this second modified embodiment, the feed roller 205 functions as the third electrode.

Figure 11:
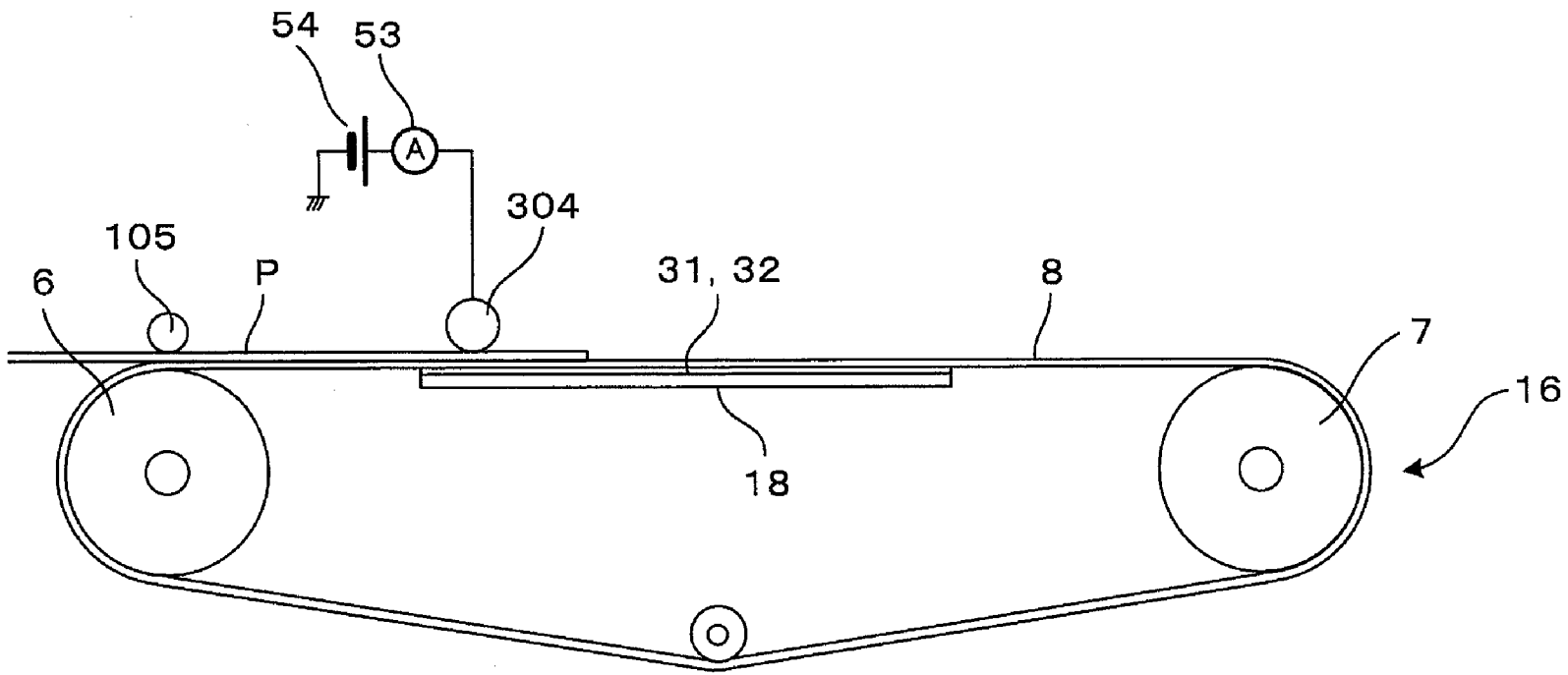
FIG. 11 is a view showing a structure of a conveyor device and its vicinity according to a third modified embodiment.

As shown in FIG. 11, the charge roller 304 according to the third modified embodiment is disposed at a position where the charge roller 304 is opposed to the electrode 31 or the electrode 32. The charge roller 304 is connected to the DC power source 54 via the ammeter 53. As in the first modified embodiment of FIG. 9, the pressing roller 105 is disposed over the belt roller 6. When the sheet P pressed onto the conveyor surface 8*a* of the conveyor belt 8 by the pressing roller 105 reaches the position where the charge roller 304 is disposed by the movement of the conveyor belt 8, the electric current flows from the charge roller 304 toward the sheet P, and the sheet P is electrically charged. In other words, the sheet P is electrified by the charge roller 304 and the electrode 31 or the electrode 32. Thus, the sheet P is attracted to the conveyor belt 8. In this third modified embodiment, the electrode 31 or the electrode 32 functions as the third electrode.

Hereinafter, the fourth through sixth embodiments relating to the control, by the controller 100, of the application voltages by the respective DC power sources 51, 54 will be explained with reference to FIGS. 12-14, respectively. The control by the controller 100 according to each of the fourth through sixth embodiments may be employed in place of the control by the controller 100 explained hereinabove. Alternatively, the control by the controller 100 explained hereinabove and the control according to each of the fourth through sixth embodiments may be selectively employed depending upon conditions. It is noted that each of the following fourth through sixth embodiments may be employed in combination with the first through third modified embodiments described above.

Figure 12:
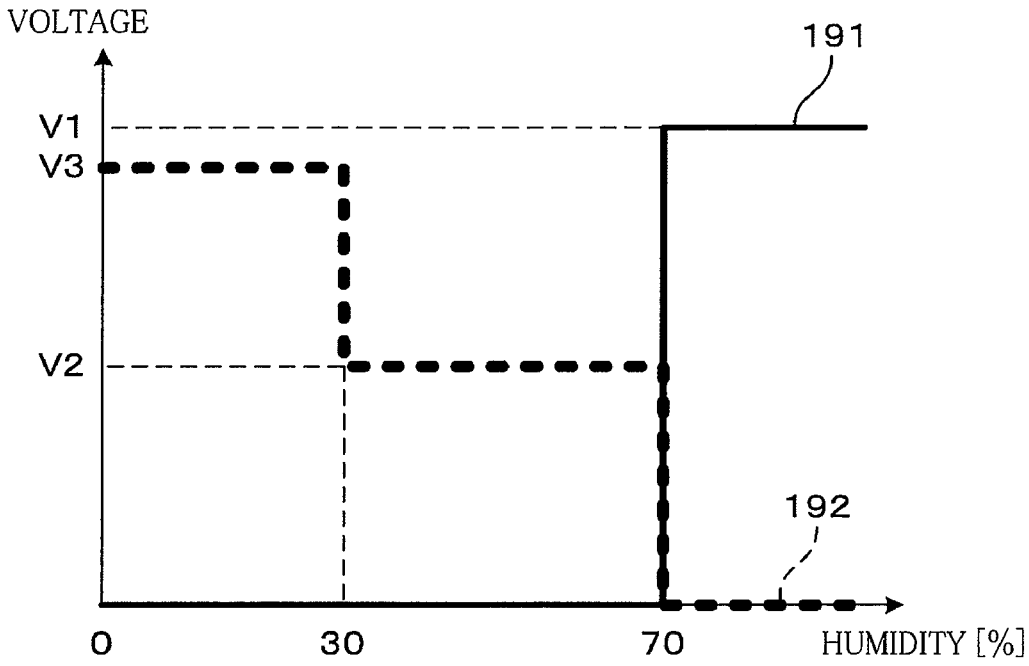
FIG. 12 is a graph showing changes of the voltages applied by the respective DC power sources under a control of the controller according to a fourth modified embodiment.
Figure 13:
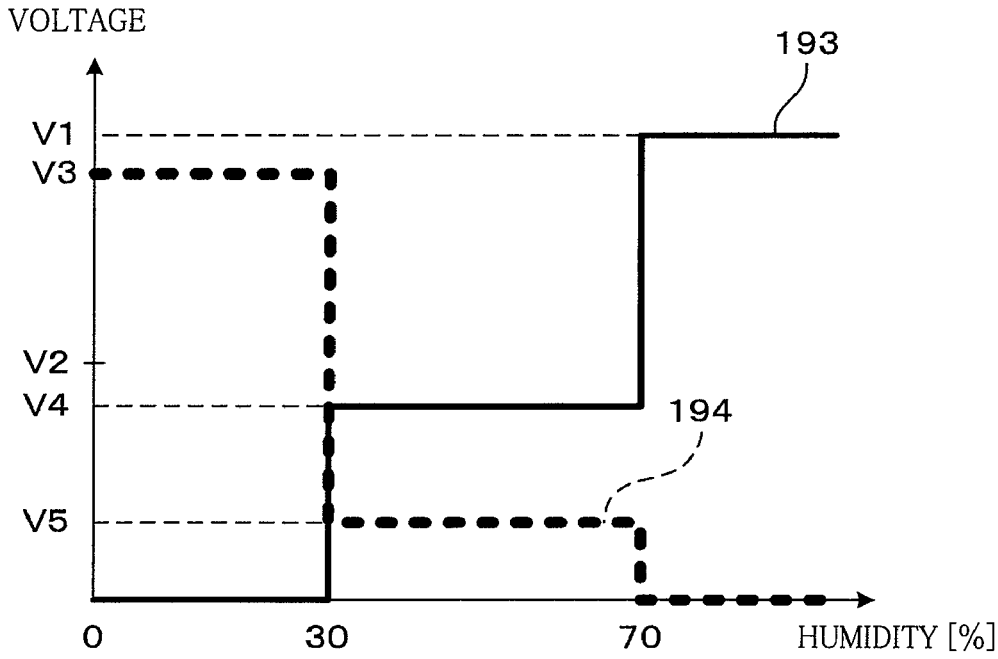
FIG. 13 is a graph showing changes of the voltages applied by the respective DC power sources under a control of the controller according to a fifth modified embodiment.
Figure 14:
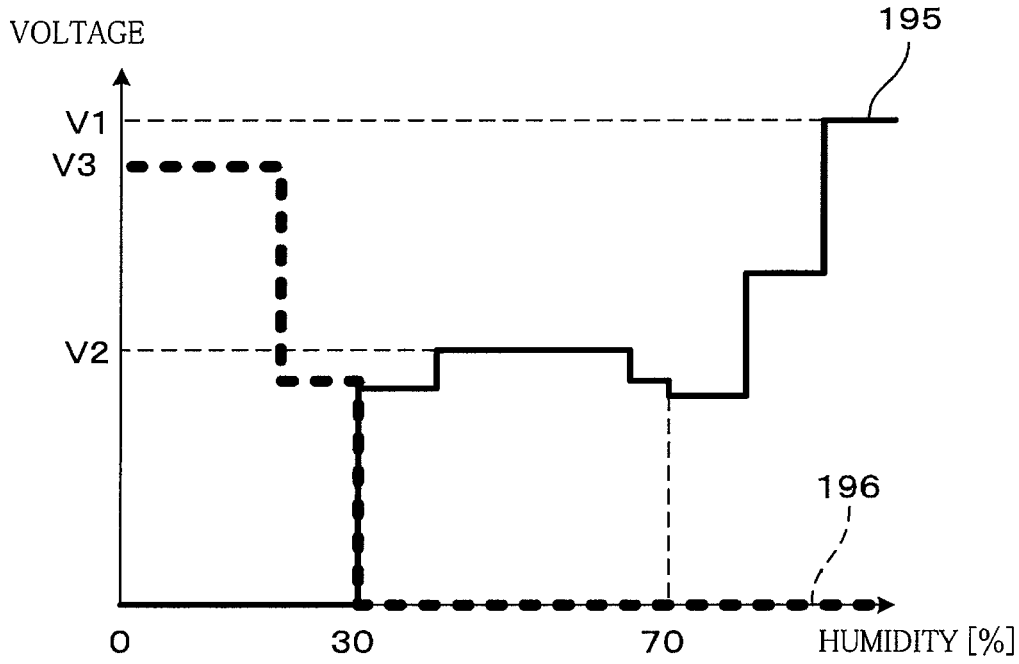
FIG. 14 is a graph showing changes of the voltages applied by the respective DC power sources under a control of the controller according to a sixth modified embodiment.

Each of the graphs of FIGS. 12-14 respectively corresponding to the fourth through sixth modified embodiments shows changes in the application voltages to be applied by the respective DC power sources 51, 54, with respect to a change in the humidity. In the graph of FIG. 12 according to the fourth modified embodiment, the solid line 191 indicates the voltage to be applied by the DC power source 51 while the broken line 192 indicates the voltage to be applied by the DC power source 54. In the illustrated embodiments explained above, the first attraction device is placed in the on state while the second attraction device is placed in the off state, when the humidity is held in the range of 30-70%. According to this fourth modified embodiment, in contrast, the first attraction device is placed in the off state while the second attraction device is placed in the on state so as to permit the DC power source 54 to apply the voltage V2, when the humidity is held in the range of 30-70%. More specifically, when the humidity is lower than 30%, the DC power source 54 applies the voltage V3 while the DC power source 51 is turned off. When the humidity is held in the range of 30-70%, the DC power source 54 applies the voltage V2 while the DC power source 51 is turned off. When the humidity is higher than 70%, the DC power source 54 applies a zero voltage while the DC power source 51 applies the voltage V1.

In the illustrated embodiments explained hereinabove including the fourth embodiment of FIG. 12, either one of the first and second attraction devices is placed in the off state when the humidity is held in the range of 30-70%. As shown in the graph of FIG. 13 according to the fifth modified embodiment, both of the first and second attraction devices may be placed in the on state when the humidity is held in the range of 30-70%. In the graph of FIG. 13, the solid line 193 indicates the voltage to be applied by the DC power source 51 while the broken line 194 indicates the voltage to be applied by the DC power source 54. In this fifth modified embodiment, the DC power source 51 applies the voltage V4 (>0) that is smaller than the voltage V2 while the DC power source 54 applies the voltage V5(>0) that is smaller than the voltage V4, when the humidity is held in the range of 30-70%. In this case, the voltage V4, V5 are preferably set such that a sum of the attractive forces to be generated by both of the first and second attraction devices is larger than the required attractive force whose magnitude is "Fn" throughout the humidity range of 30-70%.

In the illustrated embodiments explained hereinabove including the fourth modified embodiment of FIG. 12 and the fifth modified embodiment of FIG. 13, the application voltages to be applied by the respective DC power sources 51, 54 are kept constant in each of the three humidity sub-ranges, i.e., the sub-range less than 30%, the sub-range of 30-70%, and the sub-range higher than 70%. Accordingly, the required attractive force can be obtained by the simple control. From the view point of reducing wasteful power consumption and preventing an excessive current flow and excessive charging, it is preferable to apply minimum application voltages that can assure the required attractive force, instead of setting the application voltages constant. In view of this, as shown in the graph of FIG. 14 according to the sixth modified embodiment, the application voltages may be controlled so as to be minimized as long as the required attractive force Fn can be obtained, in each of the above-indicated three humidity sub-ranges, instead of setting the application voltages constant. The solid line 195 in the graph of FIG. 14 indicates the voltage to be applied by the DC power source 51 while the broken line 196 indicates the voltage to be applied by the DC power source 54. As indicated by the lines 195, 196 in the graph of FIG. 14, the application voltages may be decreased and increased [within each sub-range as long as the required attractive force Fn can be obtained.

Next, the seventh modified embodiment will be explained with reference to FIG. 15. The seventh modified embodiment relates to a modification of the electrodes 31, 32 of the first attraction device and may be combined with any of the first through sixth modified embodiments explained above. In the embodiments illustrated hereinabove, each of the electrodes 31, 32 is a member provided separately from the conveyor belt 8 so as to be in contact with an inner surface 8*b* of the conveyor belt 8 via the protective layer 33. The electrodes 31, 32 may be fixed to the conveyor belt 8. In this case, the electrodes 31, 32 may be fixed to the inner surface of the conveyor belt 8, may be embedded in the conveyor belt 8, or may be exposed to the outer surface of the conveyor belt 8.

Figure 15:
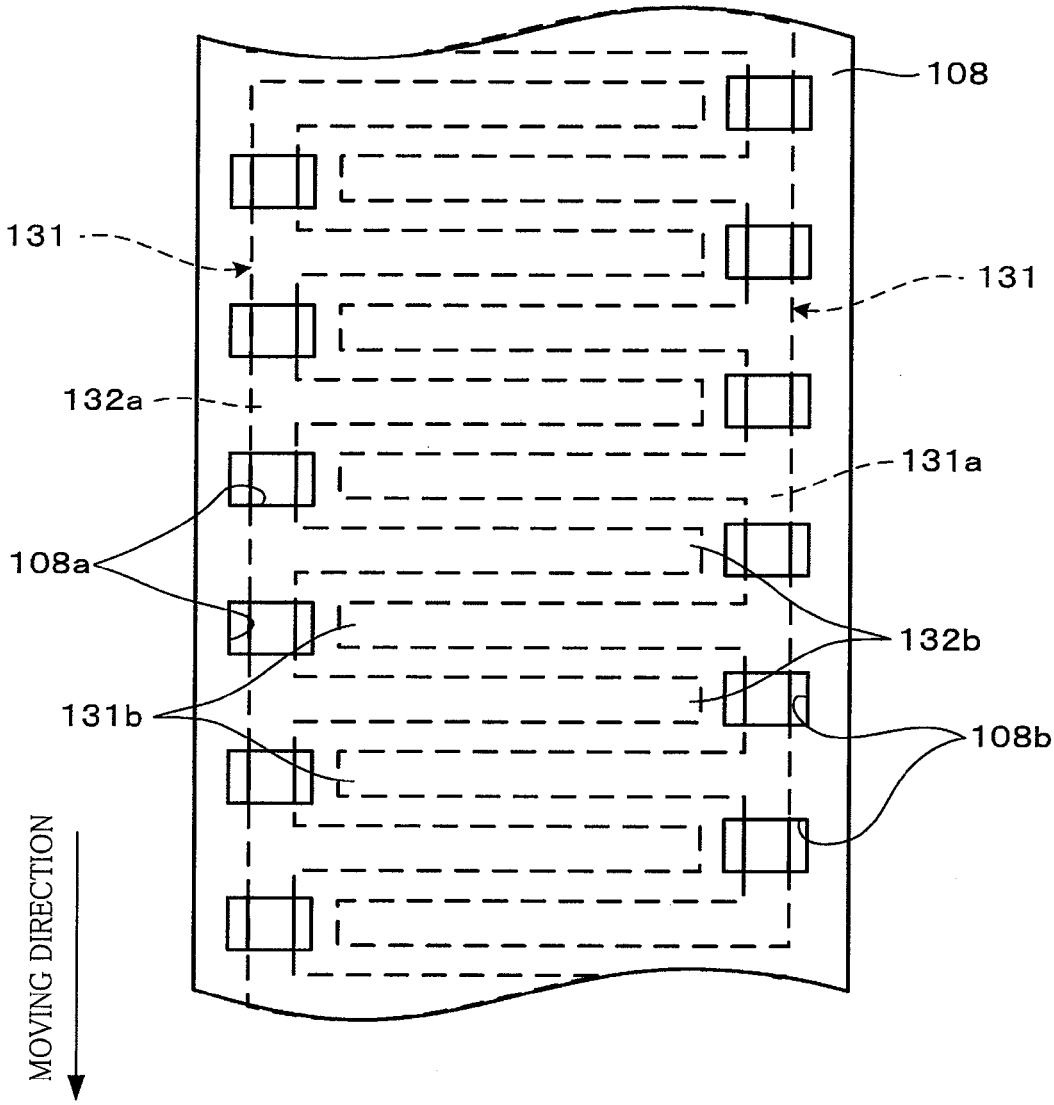
FIG. 15 is a plan view showing a conveyor belt according to a seventh modified embodiment.

In the seventh modified embodiment shown in FIG. 15, electrodes 131, 132 as a part of the first attraction device are embedded in a conveyor belt 108, in place of the electrodes 31, 32 described above. The electrode 131 has a connecting portion (beam portion) 131*a* extending in the moving direction of the conveyor belt 108 and a plurality of comb-tooth portions 131*b* extending horizontally from the connecting portion 131*a*. The electrode 132 has a connecting portion (beam portion) 132*a* extending in the moving direction of the conveyor belt 108 and a plurality of comb-tooth portions 132*b* extending horizontally from the connecting portion 132*a*. The comb-tooth portions 131*a* and the comb-tooth portions 132*a* are alternately arranged in the moving direction of the conveyor belt 108 so as to be in parallel with each other. The conveyor belt 108 is formed with: a plurality of recesses 108*a* formed on the outer surface thereof so as to reach the connecting portion 132*a*; and a plurality of recesses 108*b* formed on the outer surface thereof so as to reach the connecting portion 131*a*. The connecting portion 131*a* is exposed to the outside through the recesses 108*b* while the connecting portion 132*a* is exposed to the outside through the recesses 108*a*. In the structure, the voltage can be applied between the electrodes 131, 132 by providing brushes that respectively contact the connecting portions 131*a*, 132*a* from above the conveyor belt 108 via the recesses 108*a*, 108*b*.

In the illustrated embodiment of FIGS. 1-8 in which the electrodes 31, 32 are employed, there may be a risk that the movement of the conveyor belt 8 is hindered due to the Johnsen-Rahbeck force generated between the electrodes 31, 32 and the conveyor belt 8. In the seventh modified embodiment in which the electrodes 131, 132 are fixed to the conveyor belt 108, however, the movement of the conveyor belt 108 is not hindered.

While the preferred embodiment of the invention and the modified embodiments thereof have been described by reference to the accompanying drawings, it is to be understood that the invention is not limited to the details of those embodiments, but may be embodied with various changes and modifications, which may occur to those skilled in the art, without departing from the scope of the invention defined in the attached claims.

In the illustrated embodiments, the sheet P is electrically charged by passing the electric current using the charge rollers 4, 104, 204, 304 each as the electrifying body. The electrifying body may be embodied otherwise. For instance, the electrifying body to charge the sheet P may be configured to pass the electric current through the conveyor belt 8 using a metallic wire to which a high voltage is applied.

In the illustrated embodiments, the power sources are provided respectively for the first attraction device and the second attraction device. There may be provided a power source common to both of the first and second attraction devices.

In the illustrated embodiments, as shown in FIGS. 8 and 12-14, the application voltages are changed in steps with respect to the humidity. The application voltages may be controlled so as to be continuously changed with respect to the humidity in a smooth curved form, for instance.

In the illustrated embodiments, either one of the first and second attraction devices is completely placed in the off state when the humidity is less than 30% or when the humidity is higher than 70%. Instead of completely placing either one of the first and second attraction devices in the off state, it may be possible to keep a state in which the voltage is kept applied slightly though the level of the voltage is lower than that when the humidity is in the range of 30-70%.

In the illustrated embodiments, the detection of the humidity is realized by measuring the amount of the electric current. However, the humidity may be detected otherwise. For instance there may be utilized a dry-wet hygrometer, a hygrometer based on a change of dielectric constant.

In the illustrated embodiments, the ammeter 52, 53 may be utilized as a resistance detector configured to detect an electric resistance of the sheet P from the current that flows therethrough, and the controller 100 may be configured to control, on the basis of the detected electric resistance, at least one of the application voltage by the DC power source 51 and the application voltage by the DC power source 52. That is, the controller 100 may be configured to judge the type of the sheet P on the basis of the detected electric resistance and to control, on the basis of the judgment, the at least one of the application voltage by the DC power source 51 and the application voltage by the DC power source 52. More specifically, the controller 100 may be configured to judge, as the type of the sheet P, whether one of opposite surfaces of the sheet P has been already subjected to recording by the ink-jet heads 1 or both of the opposite surfaces of the sheet P are not yet subjected to recording by the ink-jet heads 1, and to control, on the basis of the judgment, the at least one of the application voltage by the DC power source 51 and the application voltage by the DC power source 52. Further, the controller 100 may be configured to judge, as the type of the sheet P, whether the sheet P is a plain paper or a photo paper for photo printing, and to control, on the basis of the judgment, the at least one of the application voltage by the DC power source 51 and the application voltage by the DC power source 52.

Each of the illustrated embodiments is one example in which the invention is applied to the ink-jet head configured to eject the ink from the nozzles thereof. The invention may be applicable to various liquid ejecting heads such as those configured to form fine wiring patterns on a substrate by ejecting an electrically conductive paste, to form a high-definition display by ejecting an organic luminescent material to a substrate, and to form a micro electronic device such as an optical wave guide by ejecting an optical resin to a substrate.

In the illustrated embodiments, the actuator of piezoelectric type is used. There may be used the actuator of electrostatic type or resistance heating type.

What is claimed is:

1. A recording apparatus comprising:

a recording head having an ejection surface from which a liquid is ejected; and a conveyor device having a conveyor member with a conveyor surface which is opposed to the ejection surface and on which a recording medium is placed, the conveyor device being configured to convey the recording medium in a conveyance direction by moving the conveyor member, wherein the recording apparatus further comprises a first attraction device and a second attraction device each of which is configured to permit the recording medium placed on the conveyor surface to be attracted to the conveyor surface, wherein the first attraction device comprises:

a first electrode and a second electrode each of which is opposed to one surface of the recording medium that is opposite to another surface thereof facing the ejection surface, with the recording medium placed on the conveyor surface; and a first voltage applicator configured to apply a voltage between the first electrode and the second electrode, wherein the second attraction device comprises:

an electrifying body and a third electrode between which at least one of the recording medium and the conveyor member is sandwiched; and a second voltage applicator configured to apply a voltage between the electrifying body and the third electrode, the second attraction device being configured to electrify the at least one of the recording medium and the conveyor member, and wherein the recording apparatus further comprises:

a humidity detector configured to detect humidity; and a controller configured to control, on the basis of the humidity detected by the humidity detector, at least one of the voltage to be applied by the first voltage applicator and the voltage to be applied by the second voltage applicator.

2. The recording apparatus according to claim 1, wherein the controller is configured to control, on the basis of the humidity detected by the humidity detector, the at least one of the voltage to be applied by the first voltage applicator and the voltage to be applied by the second voltage applicator, such that an attractive force by which the recording medium placed on the conveyor surface is attracted to the conveyor surface is held within a prescribed range.

3. The recording apparatus according to claim 1, wherein the controller is configured to reduce the voltage to be applied by the first voltage applicator in an instance where the humidity detected by the humidity detector is lower than first threshold humidity set for the first voltage applicator.

4. The recording apparatus according to claim 3, wherein the controller is configured to reduce the voltage to be applied by the first voltage applicator down to zero in the instance where the humidity detected by the humidity detector is lower than the first threshold humidity.

5. The recording apparatus according to claim 1, wherein the controller is configured to reduce the voltage to be applied by the second voltage applicator in an instance where the humidity detected by the humidity detector is higher than second threshold humidity set for the second voltage applicator.

6. The recording apparatus according to claim 5, wherein the controller is configured to reduce the voltage to be applied by the second voltage applicator down to zero in the instance where the humidity detected by the humidity detector is higher than the second threshold humidity.

7. The recording apparatus according to claim 1, wherein the first electrode and the second electrode are disposed so as to be in contact with a surface of the conveyor member that is opposite to the conveyor surface.

8. The recording apparatus according to claim 1, wherein the first electrode and the second electrode are fixed to the conveyor member.

9. The recording apparatus according to claim 1, wherein the conveyor member is a conveyor belt, and the conveyor device comprises a conveyance roller configured to move the conveyor belt, and wherein the conveyance roller functions as the third electrode, and the electrifying body is disposed at a position where the electrifying body cooperates with the conveyance roller to sandwich the conveyor belt therebetween.

10. The recording apparatus according to claim 9, wherein the electrifying body cooperates with the conveyor belt to sandwich the recording medium therebetween at the position.

11. The recording apparatus according to claim 1, wherein the electrifying body is disposed at a position where the electrifying body cooperates with one of the first electrode and the second electrode to sandwich the recording medium therebetween, and the one of the first electrode and the second electrode functions as the third electrode.

12. The recording apparatus according to claim 1, wherein the electrifying body and the third electrode are disposed at respective positions where the electrifying body and the third electrode cooperate with each other to sandwich the recording medium therebetween on an upstream side of the conveyor member in the conveyance direction.

13. The recording apparatus according to claim 1, wherein the humidity detector comprises at least one of a current sensor configured to detect an electric current flowing between the first electrode and the second electrode; and a current sensor configured to detect an electric current passing through the electrifying body.

14. The recording apparatus according to claim 1, wherein the electrifying body is a charge roller.

15. A recording apparatus, comprising:

a recording head having an ejection surface from which a liquid is ejected; and a conveyor device having a conveyor member with a conveyor surface which is opposed to the ejection surface and on which a recording medium is placed, the conveyor device being configured to convey the recording medium in a conveyance direction by moving the conveyor member, wherein the recording apparatus further comprises a first attraction device and a second attraction device each of which is configured to permit the recording medium placed on the conveyor surface to be attracted to the conveyor surface, wherein the first attraction device comprises:

a first electrode and a second electrode each of which is opposed to one surface of the recording medium that is opposite to another surface thereof facing the ejection surface, with the recording medium placed on the conveyor surface; and a first voltage applicator configured to apply a voltage between the first electrode and the second electrode, wherein the second attraction device comprises:

an electrifying body and a third electrode between which at least one of the recording medium and the conveyor member is sandwiched; and a second voltage applicator configured to apply a voltage between the electrifying body and the third electrode, the second attraction device being configured to electrify the at least one of the recording medium and the conveyor member, and wherein the recording apparatus further comprises:

a resistance detector configured to detect an electric resistance of the recording medium to be placed on the conveyor surface; and a controller configured to control, on the basis of the electric resistance of the recording medium detected by the resistance detector, at least one of the voltage to be applied by the first voltage applicator and the voltage to be applied by the second voltage applicator.

16. The recording apparatus according to claim 15, wherein the controller is configured to judge a type of the recording medium on the basis of the electric resistance thereof detected by the resistance detector, and to control, on the basis of the judgment, the at least one of the voltage to be applied by the first voltage applicator and the voltage to be applied by the second voltage applicator.

17. The recording apparatus according to claim 16, wherein the controller is configured to judge, as the type of the recording medium, whether one of opposite surfaces of the recording medium has been already subjected to recording by the recording head or both of the opposite surfaces of the recording medium are not yet subjected to recording by the recording head, and to control, on the basis of the judgment, the at least one of the voltage to be applied by the first voltage applicator and the voltage to be applied by the second voltage applicator.

18. The recording apparatus according to claim 16, wherein the controller is configured to judge, as the type of the recording medium, whether the recording medium is a plain paper or a photo paper for photo printing, and to control, on the basis of the judgment, the at least one of the voltage to be applied by the first voltage applicator and the voltage to be applied by the second voltage applicator.

* * * * *